US005554102A

United States Patent [19]

Chiou

[11] Patent Number: 5,554,102

[45] Date of Patent: Sep. 10, 1996

[54] PORTABLE MASSAGING DEVICE

[76] Inventor: Shih-Kuen Chiou, No. 584, Sec. 2, Chung-San Rd., Hwu-Lian Village, Yeongjing Shiang, Changhua Shiann, Taiwan

[21] Appl. No.: 425,505

[22] Filed: Apr. 20, 1995

[51] Int. Cl.[6] ..... A61H 1/00; A61H 15/00

[52] U.S. Cl. ..... 601/72; 601/118; 601/119

[58] Field of Search ..... 601/63, 69, 70–73, 601/78–81, 118–122

[56] References Cited

U.S. PATENT DOCUMENTS

| | | | |
|---|---|---|---|
| 1,728,368 | 9/1929 | Saxer | 601/120 X |
| 2,307,554 | 1/1943 | Wettlaufer | 601/120 X |
| 2,472,385 | 6/1949 | Rollman | 601/119 X |
| 2,787,261 | 4/1957 | McDonald et al. | 601/19 |
| 3,451,391 | 6/1969 | Tavel | 601/72 |
| 5,413,551 | 5/1995 | Wu | 601/46 |

FOREIGN PATENT DOCUMENTS

| | | | |
|---|---|---|---|
| 646382 | 2/1994 | Australia | 601/118 |
| 2205031 | 8/1973 | Germany | 601/72 |
| 3207693 | 9/1983 | Germany | 601/78 |
| 2186489 | 8/1987 | United Kingdom | 601/121 |

*Primary Examiner*—Robert A. Hafer
*Assistant Examiner*—Brian E. Hanlon
*Attorney, Agent, or Firm*—Browdy and Neimark

[57] ABSTRACT

A portable massaging device comprises a cylindrical body in which a power unit is housed and over which a massaging set is fitted. The power unit is composed of a motor, a battery set, a cam and a conducting member. The massaging set is composed of a plurality of fitting members and massaging nipples. The fitting members are provided respectively with a plurality of receiving recesses in which the massaging nipples are held. The fitting members are further provided respectively in the connection ends thereof with a plurality of mortises and tenons, by way of which the fitting members are held together. An end cap is fastened to one end of the cylindrical body for locating the massaging set and for shielding the power unit. A handle is fastened at one end thereof with the end cap and at another end thereof with the conducting member.

4 Claims, 2 Drawing Sheets

PORTABLE MASSAGING DEVICE

FIELD OF THE INVENTION

The present invention relates generally to a health device, and more particularly to a massaging device.

BACKGROUND OF THE INVENTION

There are a variety of massaging devices currently available at the market place. These conventional massaging devices are of various sizes and are rather complicated in construction. As a result, these prior art massaging devices are not cost-effective.

SUMMARY OF THE INVENTION

It is therefore the primary objective of the present invention to provide a portable massaging device, which can be used conveniently at any locality.

It is another objective of the present invention to provide a portable massaging device, which is simple and ingenious in construction and can be made economically.

In keeping with the principle of the present invention, the foregoing objectives of the present invention are attained by a portable massaging device comprising a massaging apparatus and a handle. The massaging apparatus comprises a cylindrical body in which a power unit is disposed and over which a massaging set is fitted. The power unit is composed of a motor, a battery set, a cam and a conducting member. The massaging set is composed of a plurality of fitting members and massaging nipples. The front and the rear fitting members are provided respectively at one end thereof with a plurality of receiving recesses of a semispherical construction. Those fitting members which are located between the front and the rear outer fitting members are provided respectively at both ends thereof with a plurality of receiving recesses of a semispherical construction. The receiving recesses are provided respectively on the outer top edge thereof with a covering edge. The fitting members are provided respectively in the connection ends thereof with a mortise and a tenon. The receiving recesses are dimensioned to receive therein the massaging nipples. An end cap is engaged with one end of the cylindrical body for locating the massaging set. The handle is fastened at one end thereof with the end cap and at another end thereof with the conducting member.

The foregoing objectives, features, functions and advantages of the present invention will be more readily understood upon a thoughtful deliberation of the following detailed description of the present invention in conjunction with the accompanying drawings.

DETAILED DESCRIPTION OF THE INVENTION

Figure 1:
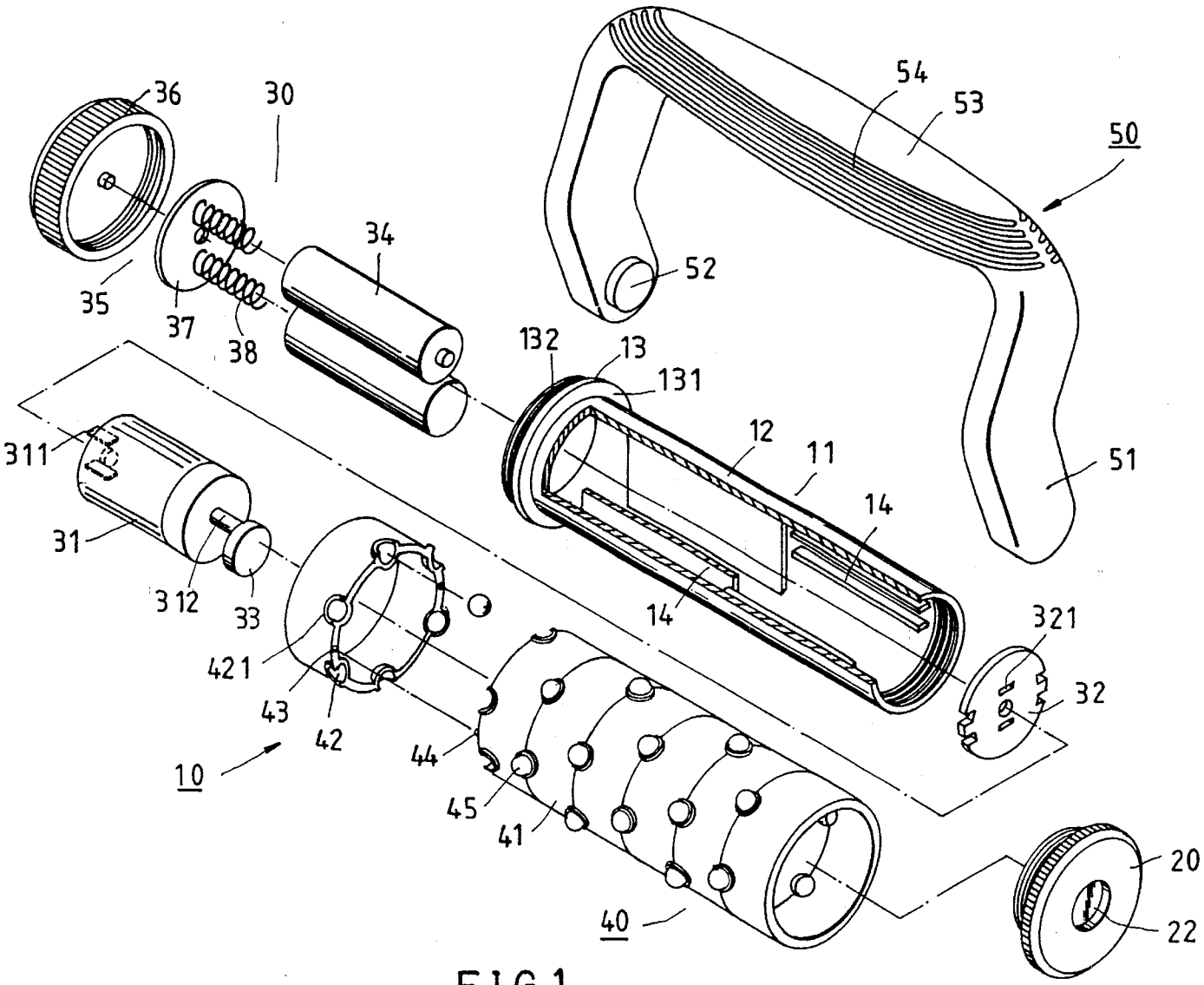
FIG. 1 shows an exploded view of a massaging device of the present invention.
Figure 3:
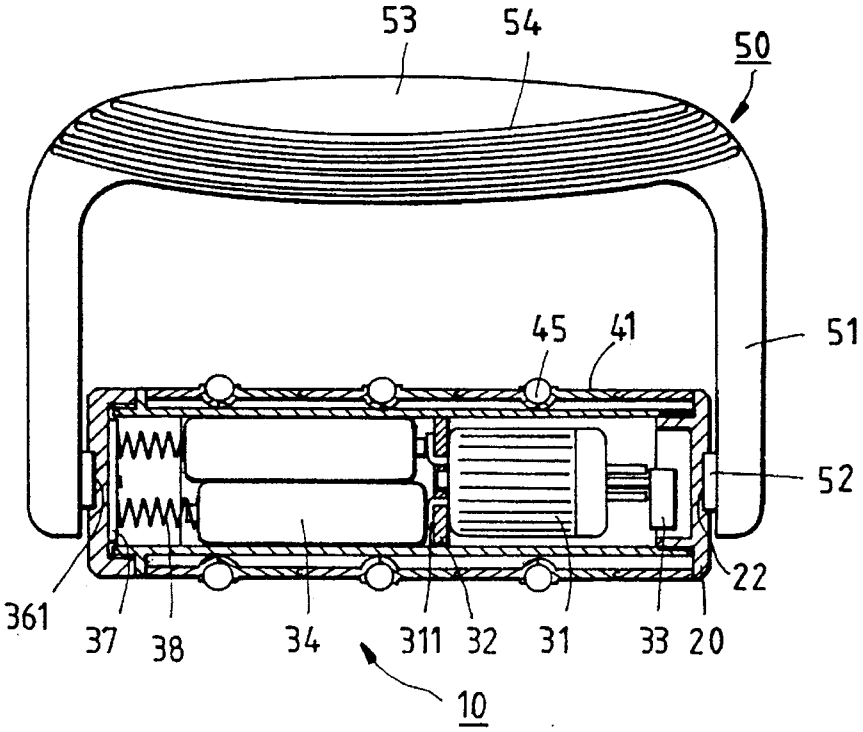
FIG. 3 shows a sectional view of a portion taken along the line 3—3 as shown in FIG. 2.
Figure 2:
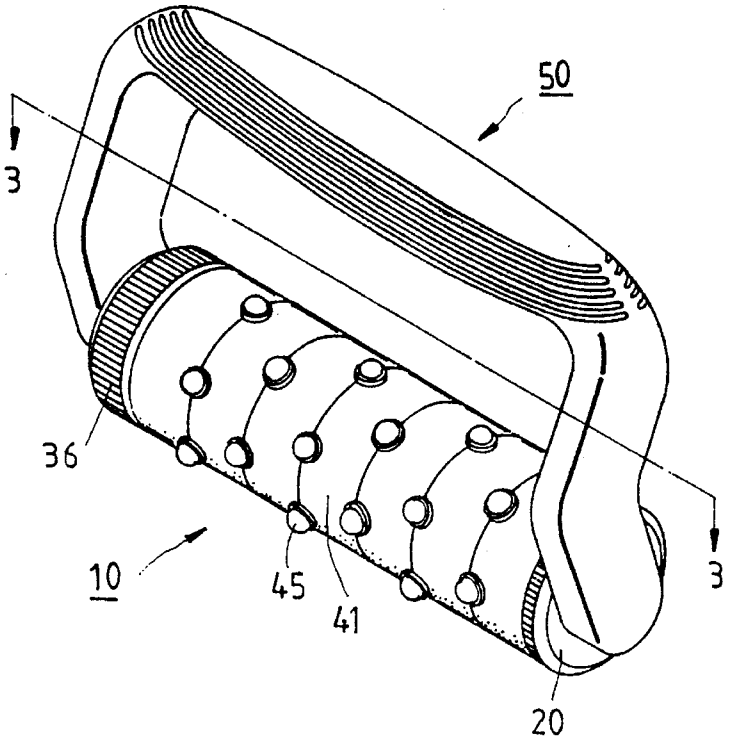
FIG. 2 shows a perspective view of the massaging device in combination according to the present invention.

As shown in FIGS. 1–3, a massaging device embodied in the present invention comprises a massaging apparatus 10 and a handle 50.

The massaging apparatus 10 is made up of the component parts which are described explicitly hereinafter.

An inner housing 11 has a cylindrical body 12 which is provided at one end thereof with a connection portion 13 having a stepped portion or annular flange 131 adjacent to the cylindrical body 12. The connection portion 13 is provided at the outer portion thereof with an outer threaded portion 132. The cylindrical body 12 is provided on the inner wall surface thereof with a plurality of locating ribs 14 and is further provided on the inner wall surface of another end thereof with threads engageable with an end cap 20 which is provided centrally in the outer side thereof with a retaining slot 22.

A power unit 30 is composed of a motor 31, a stopping piece 32, a cam 33, a battery set 34, and a conducting member 35. The motor 31 is located in the interior of another end of the cylindrical body 12 such that the motor 31 is located by the locating ribs 14. The motor 31 is provided at the inner end thereof with two conducting pieces 311. The stopping piece 32 is disposed in the cylindrical body 11 such that the stopping piece 32 is located at the midpoint of the cylindrical body 11 so as to divide the interior of the cylindrical body 12 a front segment and a rear segment. The stopping piece 32 is provided centrally with two through holes 321 dimensioned to hold therein the two conducting pieces 311. The cam 33 is mounted on a shaft 312 of the motor 31. The two batteries 34 are disposed in the cylindrical body 12 such that the positive terminal of 1 battery and the negative terminal of another of the two batteries 34 are in contact with the two conducting pieces 311 of the motor 31. The conducting member 35 comprises a cover 36 engageable with the outer threaded portion 132 of the connection portion 13 of the cylindrical body 12. The cover 36 is provided in the outer side thereof with a retaining slot 361 and is further provided in the inner side thereof with a rotatable piece 37 which is made of a metal material and is so pivoted to the cover 36 that the rotatable piece 37 can be rotated in relation to the cover 36. Two conducting springs 38 are fastened respectively at one end thereof with the rotatable piece 37 and are connected respectively at another end thereof with the respective positive and the negative terminals of the two batteries 34. The cover 36 is rotatably engaged with the outer threaded portion 132 of the connection portion 13 of the cylindrical body 11. As a result, when the cover 36 is so rotated as to move toward the connection portion 13, the rotatable piece 37 can not be actuated, thereby permitting the power unit 30 to remain connected with the cam 33 capable of bringing about an eccentric rotation.

A massaging set 40 is composed of a plurality of outer fitting members 41 and massaging nipples 45. The front and the rear fitting members 41 are provided respectively at one end thereof with a plurality of receiving recesses 42 of a semispherical construction. Those fitting members 41 which are located between the front and the rear fitting members 41 are provided respectively at both ends thereof with a plurality of receiving recesses 42 of a semispherical construction. The receiving recesses 42 are provided respectively on the outer top edge thereof with a covering edge 421. The fitting members 41 are provided respectively in the connection ends thereof with a mortise 43 and a tenon 44. The massaging nipples 45 are received respectively in the receiving recesses 42 such that the massaging nipples 45 are prevented from becoming disengaged with the receiving recesses 42 by the covering edges 421 of the receiving recesses 42. The fitting members 41 are held together by means of mortises 43 and tenons 44. The massaging set 40 is fitted over the cylindrical body 11 such that the massaging set 40 is stopped at one end thereof by the stepped portion 131 of the cylindrical body 11, and that the massaging set 40 is urged at another end thereof by the end cap 20.

A handle 50 has two pivoting arms 51 and a grip 53. The pivoting arms 51 are designed in conformity with the engineering of a human body and are provided respectively on the inner side of the bottom end thereof with a retaining protuberance 52 engageable securely with the retaining slot 22 of 361. The grip 53 is provided thereon with a plurality of arcuate grooves 54 to facilitate the easy and comfortable holding of the handle 50.

In operation, the cover 36 is rotated in the direction toward the outer threaded portion 132 of the connection portion 13 of the cylindrical body 11 so as to start the motor 31. The cam 33 is then actuated by the motor 31 to rotate eccentrically so as to bring about a vibrational motion, which is transmitted to the massaging set 40 in contact with a use's body portion intended to be massaged.

The embodiment of the present invention described above is to be regarded in all respects as merely illustrative and not restrictive. Accordingly, the present invention may be embodied in other specific forms without deviating from the spirit thereof. The present invention is therefore to be limited only by the scope of the following appended claims.

What is claimed is:

1. A portable massaging device comprising:

a cylindrical body having first and second ends, said cylindrical body first end provided with a connection portion including an annular flange and an outer threaded portion, said cylindrical body further provided on an inner wall surface of said second end with an inner threaded portion;

a massaging set fitted over said cylindrical body such that one end of said massaging set is stopped by said annular flange of said cylindrical body, said massaging set comprising a plurality of fitting members and massaging nipples, said fitting members provided with a plurality of receiving recesses in which said massaging nipples are securely held, said fitting members further provided respectively with a plurality of mortises and tenons for holding said fitting members together;

a power unit housed in said cylindrical body and comprising a motor having at one end a shaft on which a cam is mounted, said motor having at an opposite end of said motor two conducting pieces engageable respectively with the positive terminal of a battery and the negative terminal of another battery, said power unit further including a conducting member having a cover engageable with said outer threaded portion of said connection portion of said cylindrical body, said conducting member further including a rotatable piece pivoted to said cover and two conducting springs which are fastened to said rotatable piece, one of said conducting springs engaging the positive terminal of said another battery and the other of said conducting springs engaging the negative terminal of said battery;

an end cap engaging said inner threaded portion of said cylindrical body for locating said massaging set and for shielding said power unit; and a handle comprising first and second arms each having a retaining projection, wherein said end cap and said cover of said power unit have inner and outer sides and said end cap and cover outer sides are each provided with a retaining slot; said first arm retaining projection securely engaging one of said retaining slots and said second arm retaining projection securely engaging the other of said retaining slots.

2. The portable massaging device as defined in claim 1, wherein said cylindrical body is provided on an inner wall thereof with a plurality of ribs for locating said motor and said batteries.

3. A portable massaging device comprising:

a cylindrical body having first and second ends, said cylindrical body first end provided with a connection portion including an annular flange and an outer threaded portion, said cylindrical body further provided on an inner wall surface of said second end with an inner threaded portion;

a massaging set fitted over said cylindrical body such that one end of said massaging set is stopped by said annular flange of said cylindrical body, said massaging set comprising a plurality of fitting members and massaging nipples, said fitting members provided with a plurality of receiving recesses in which said massaging nipples are securely held said fitting members further provided respectively with a plurality of mortises and tenons for holding said fitting members together;

a power unit housed in said cylindrical body and comprising a motor having at one end a shaft on which a cam is mounted, said motor having at an opposite end two conducting pieces engageable respectively with the positive terminal of a battery and the negative terminal of another battery, said power unit further including a conducting member having a cover engageable with said outer threaded portion of said connection portion of said cylindrical body, said conducting member further including a rotatable piece pivoted to said cover and two conducting springs which are fastened to said rotatable piece, one of said conducting springs engaging the positive terminal of said another battery and the other of said conducting springs engaging the negative terminal of said battery;

an end cap engaging said inner threaded portion of said cylindrical body for locating said massaging set and for shielding said power unit; and a handle comprising first and second arms each having a retaining projection, wherein said end cap and said cover of said power unit have inner and outer sides and said end cap and cover outer sides are each provided with a retaining slot; said first arm retaining projection securely engaging one of said retaining slots and said second arm retaining projection securely engaging the other of said retaining slots;

wherein said massaging nipples and said recesses are substantially spherical and said recesses are formed between adjacent ones of said fitting members.

4. The device according to claim 3, wherein each said recess includes a respective covering edge.

* * * * *